United States Patent [19]

Arai

[11] Patent Number: 4,966,359

[45] Date of Patent: Oct. 30, 1990

[54] PAPER FEED UNIT FOR IMAGE FORMING APPARATUSES

[75] Inventor: Kiyotaka Arai, Osaka, Japan

[73] Assignee: Mita Industrial Co., Ltd., Osaka, Japan

[21] Appl. No.: 400,438

[22] Filed: Aug. 30, 1989

[30] Foreign Application Priority Data

Aug. 31, 1988 [JP] Japan ..... 63-217706

[51] Int. Cl.[5] ..... B65H 7/02

[52] U.S. Cl. ..... 271/110; 271/265

[58] Field of Search ..... 271/110, 111, 264, 265

[56] References Cited

U.S. PATENT DOCUMENTS 4,621,799 11/1986 Bastow et al. ..... 271/110 X 4,892,299 1/1990 Hayama ..... 271/110

FOREIGN PATENT DOCUMENTS 63-41040 3/1988 Japan .

*Primary Examiner*—Richard A. Schacher

*Attorney, Agent, or Firm*—Armstrong, Nikaido, Marmelstein, Kubovcik & Murray

[57] ABSTRACT

A paper feed unit for image forming apparatuses comprising a paper feed roller assembly having a paper feed shaft rotatably supported in the body of the image forming apparatus and a paper feed section slidably mounted on the paper feed shaft for removal therefrom and fixed to the paper feed shaft for integral rotation therewith, the rotation of said paper feed section causing a roller of said paper feed roller assembly to rotationally contact the paper, thereby feeding the paper; and a paper detection switch so fixed to a given mounting portion adjacent to the paper feed section as to detect the presence of the paper to be fed by the paper feed roller assembly and mounted in such a way as to slide following a slide in the paper feed section when unfixed from the mounting portion.

8 Claims, 5 Drawing Sheets

FIG. 3
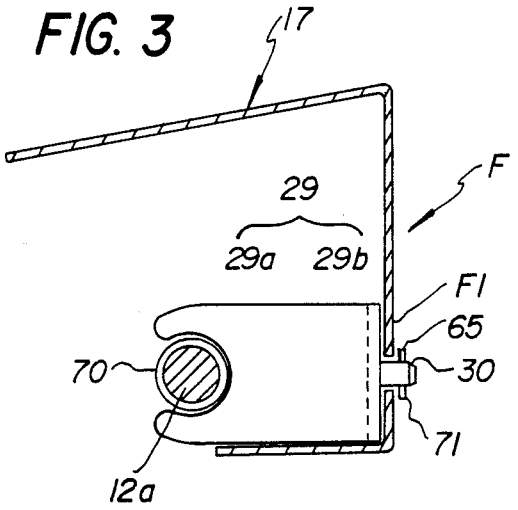
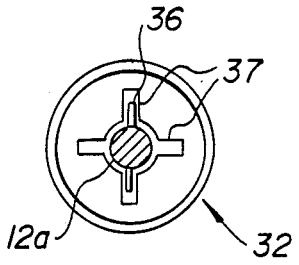
FIG. 4
FIG. 5
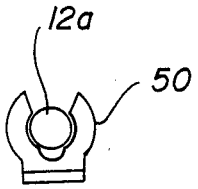
FIG. 6
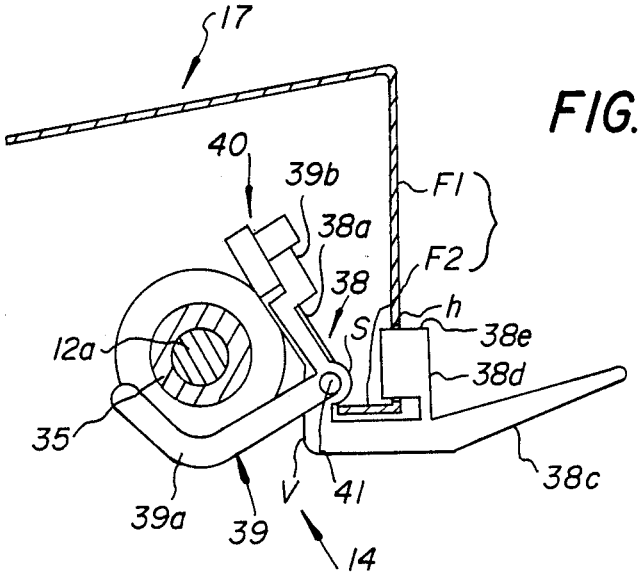

PAPER FEED UNIT FOR IMAGE FORMING APPARATUSES

BACKGROUND OF THE INVENTION

1. Field of the invention:

The present invention relates to a paper feed unit for feeding paper on which an image is formed in an image forming apparatus. More particularly, it relates to a paper feed unit having a replaceable roller which rotationally contacts paper so as to feed the paper and a paper detection switch for detecting the presence of the paper to be fed by the roller.

2. Description of the prior art:

In an image forming apparatus, an image is formed on paper fed by a paper feed unit. Generally, a paper feed unit of an image forming apparatus is so constructed that a roller mounted on a paper feed shaft rotates while contacting the paper to be fed for feeding the paper into an image forming section. Because the roller wears due to rotational contact with the paper, the paper feed performance will deteriorate with use over a long period of time. Therefore, the roller is replaceably mounted, as is known. Also, the paper feed unit is usually provided with a paper detection device for detecting the presence of the paper to be fed. Because of the need for detecting the presence of the paper that the roller rotationally contacts, the paper detection device is disposed adjacent to the roller, which in turn presents interference when replacing the roller. In particular, when the paper is transported by making reference to the center of its width orthogonal to its transporting direction, since the paper detection device is so disposed as to detect that center, the paper detection device has to be removed for the time when replacing the roller. However, since the paper detection device is usually fixed in position with a screw, etc., the paper detection device must be refixed in position with the screw, etc., after removing the paper detection device and replacing the roller, thus requiring complicated work for replacement of the roller.

SUMMARY OF THE INVENTION

The paper feed unit for image forming apparatuses of this invention, which overcomes the above-discussed and numerous other disadvantages and deficiencies of the prior art, comprises: a paper feed roller assembly having a paper feed shaft rotatably supported in the body of the image forming apparatus and a paper feed section slidably mounted on the paper feed shaft for removal therefrom and fixed to the paper feed shaft for integral rotation therewith, the rotation of said paper feed section causing a roller of said paper feed roller assembly to rotationally contact the paper, thereby feeding the paper; and a paper detection switch so fixed to a given mounting portion adjacent to the paper feed section as to detect the presence of the paper to be fed by the paper feed roller assembly and mounted in such a way as to slide following a slide in the paper feed section when unfixed from the mounting portion.

In a preferred embodiment, the paper feed section of the paper feed roller assembly comprises a plurality of rollers mounted appropriately spaced apart on the paper feed shaft, and a connecting member mounted on the paper feed shaft for connecting the rollers.

In a preferred embodiment, the paper detection switch is so fixed to the mounting portion as to position itself between the adjacent rollers.

In a preferred embodiment, the mounting portion is provided with a rail which the paper detection switch unfixed from the mounting portion engages with and slides on, the rail being formed in parallel with the paper feed shaft.

In a preferred embodiment, the rail is provided with a cut-out portion to facilitate the unfixing of the paper detection switch.

In a preferred embodiment, the paper detection switch is connected to a lead wire by means of a connector when fixed to the mounting portion.

In a preferred embodiment, one end of the paper feed shaft is supported on the body of the image forming apparatus.

In a preferred embodiment, the paper feed section has a roller section and a supporting shaft inserted through the axis of the roller section and mounted integrally with the roller section.

Thus, the invention described herein makes possible the objectives of (1) providing a paper feed unit of image forming apparatuses in which the paper detection switch fixed to the specified mounting position can be readily unfixed from the position for sliding to a position where the paper detection switch does not present any interference when replacing the paper feed section having a roller, etc., thereby greatly enhancing the replaceability of the paper feed section; (2) providing a paper feed unit of image forming apparatuses in which the paper detection switch, when unfixed from the specified mounting portion, is allowed to engage with and slide along the rail formed on the mounting portion, and the paper detection switch is then disengaged from the rail through the cut-out portion formed therein, so as to be securely relocated when replacing the paper feed section; and (3) providing a paper feed unit of image forming apparatuses in which the paper detection switch is connected to the lead wire by means of a connector when fixed to the mounting portion, and is disconnected from the lead wire before being made to slide, and therefore, it is not necessary to move the lead wire when the paper detection switch is made to slide, thus eliminating the possibility of breaking the lead wire.

BRIEF DESCRIPTION OF THE DRAWINGS

This invention may be better understood and its numerous objects and advantages will become apparent to those skilled in the art by reference to the accompanying drawings as follows:

FIG. 3 is a cross sectional view showing the main portion of the paper feed unit of FIG. 2 for explanation of a supporting plate for a paper feed shaft.

FIG. 4 is a cross sectional view showing the main portion of the paper feed unit of FIG. 2 for explanation of the relationship between a roller of the paper feed section and the paper feed shaft.

FIG. 5 is a side view showing the paper feed section of FIG. 2 for explanation of a free end of the paper feed shaft.

FIG. 6 is a cross sectional view showing the main portion of the paper feed unit of FIG. 2 for explanation of a paper detection switch.

DESCRIPTION OF THE PREFERRED EMBODIMENTS

Figure 1:
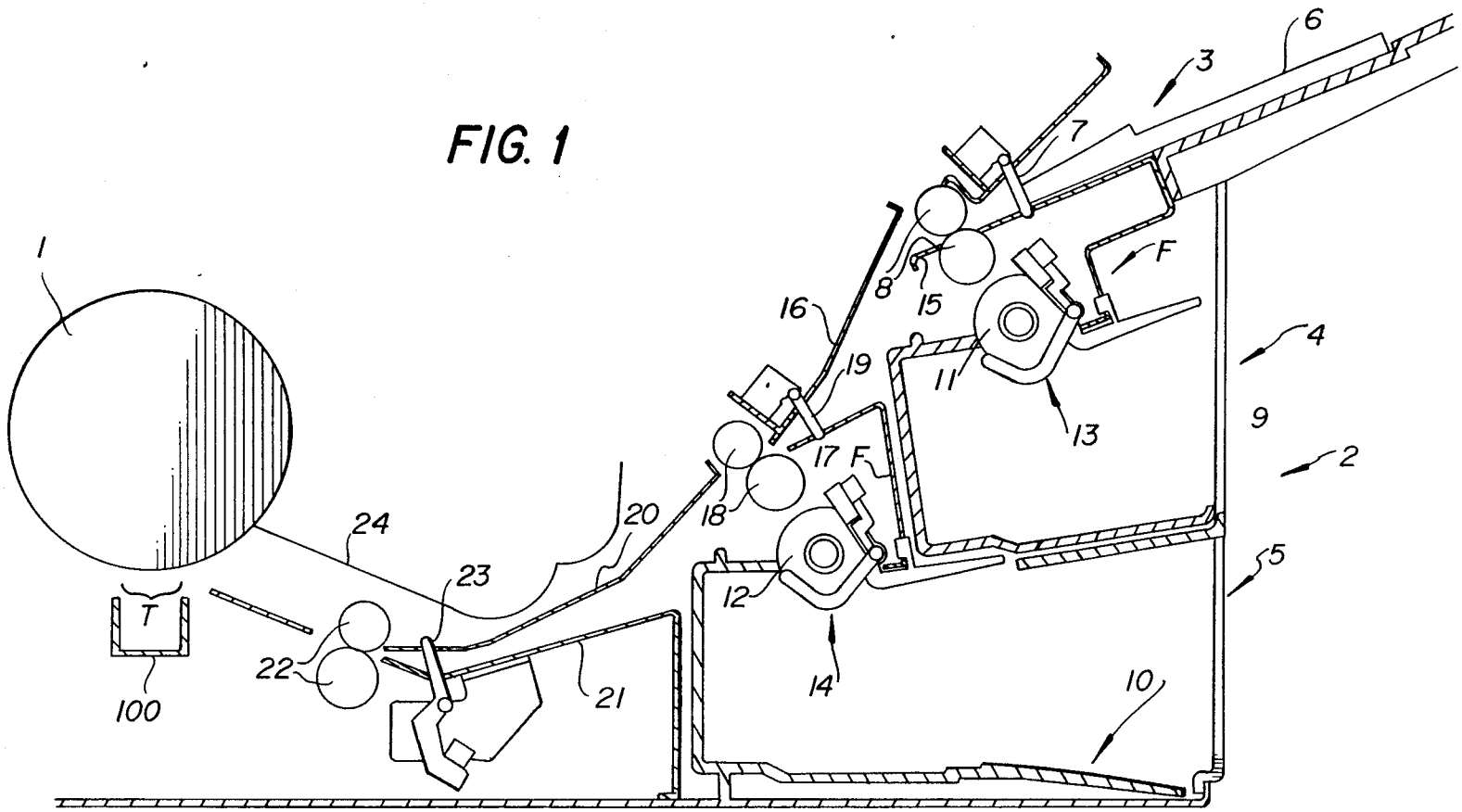
FIG. 1 is a cross sectional view showing a paper feed unit and its adjacent parts in an image forming apparatus of the present invention.

The paper feed unit for an image forming apparatus of the present invention is installed on one side of the image forming apparatus, as shown in FIG. 1. In the image forming apparatus, an image is formed in an image forming section which is disposed in the middle thereof and which includes a photoconductor drum 1 and other components. The paper feed unit 2 of the present invention feeds paper to a transfer area T on the photoconductor drum 1, the transfer area T facing a transfer unit 100. The paper feed unit 2 is provided with a manual paper feed means 3 in the upper part thereof. Beneath the manual paper feed means 3 are disposed an upper cassette paper feed means 4 and a lower cassette paper feed means 5, one on top of the other. The paper is fed using one of the manual paper feed means 3, the upper cassette paper feed means 4 or the lower cassette paper feed means 5 whichever is selected.

The manual paper feed means 3 is provided with a manual feed tray 6 on which the paper to be fed is placed. Downstream in the paper feeding direction of the manual feed tray 6, a paper detection switch 7 is disposed for detecting the paper placed on the manual feed tray 6, while paper feed rollers 8 are disposed downstream in the paper feeding direction of the paper detection switch 7. The paper feed rollers 8 are made to rotate when the paper detection switch 7 has detected the paper, to feed the paper on the manual feed tray 6 into the body of the image forming apparatus.

The upper cassette paper feed means 4 and the lower cassette paper feed means 5 are approximately of the same construction, and include cassette receivers 9 and 10, respectively, each for accommodating a cassette (not shown) holding sheets of paper. Above the cassette receivers 9 and 10 and downstream in the paper feeding direction, there are disposed paper feed roller assemblies 11 and 12 for feeding into the body of the image forming apparatus the paper in the respective cassettes accommodated in the respective cassette receivers 9 and 10, as well as paper detection switches 13 and 14 for detecting the presence of the paper in the respective cassettes.

The paper fed from the manual paper feed means 3 is transported by being guided first along a guide plate 15 disposed contiguously with the manual feed tray 6 and then along a guide plate 16 disposed contiguously to the guide plate 15. The guide plate 16 guides the paper diagonally downward to paper feed rollers 18 with the help of a guide plate 17 disposed facing the lower portion of the guide plate 16. The portion of the guide plate 15 that guides the paper has a slightly sloping surface with respect to the horizontal plane, while the end thereof opposite from the guiding portion is formed along an approximately vertical plane to form a mounting portion F. The paper fed from the upper cassette paper feed means 4 is transported to the paper feed rollers 18 through the lower portion of the guide plate 16 and the guide plate 17. The portion of the guide plate 17 excluding the portion for guiding the paper is also formed along an approximately vertical plane to form a mounting portion F.

Upstream of and adjacent to the paper feed rollers 18, a paper detection switch 19 is disposed for detecting the paper being transported, the paper feed rollers 18 being made to rotate, after a given time has passed after the activation of the paper detection switch by the leading edge of the paper being transported. Thus, the leading edge of the paper being transported is made to abut against the paper feed rollers 18 and aligned with the line perpendicular to the paper transporting direction, thereby preventing the paper from being transported in a slanting direction.

The paper transported by the paper feed roller 18 is guided along a pair of upper and lower guide plates 20 and 21, and delivered to resist rollers 22. The paper fed from the lower cassette paper feed means 5 is delivered from the lower cassette paper feed means 5 directly to the resist rollers 22 through the guide plates 20 and 21. Upstream of and adjacent to the resist rollers 22, a resist switch 23 is disposed for detecting the paper being transported. The resist rollers 22 are made to rotate, after a given time has passed after the activation of the resist switch 23 by the leading edge of the paper being transported. Thus, the leading edge of the paper is made to abut against the resist rollers 22 so as to be aligned with the line perpendicular to the transporting direction, thereby preventing the paper from being transported in a slanting direction. The resist rollers 22 are so constructed as to be rotated in synchronization with an exposure timing, etc., of an optical system. Upwardly of the resist roller 22, a developer unit 24 is disposed.

Figure 2:
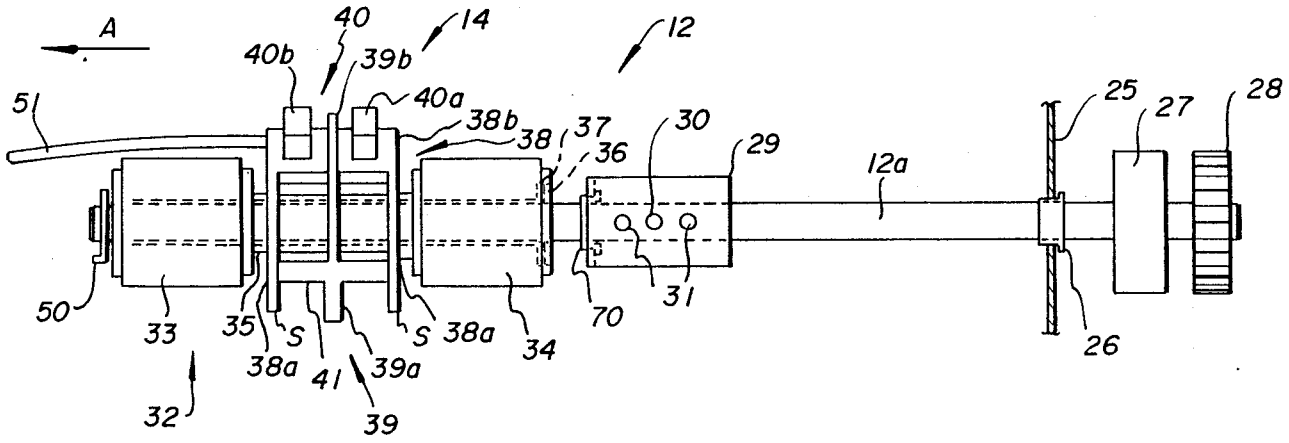
FIG. 2 is a plan view showing portions of the paper feed unit of FIG. 1.

The paper feed roller assembly 12 in the lower cassette paper feed means 5 has, as shown in FIG. 2, a paper feed shaft 12*a* one end of which is rotatably supported on a side panel 25 on the rear of the image forming apparatus body by means of a bearing 26 and the other end of which is made free. On the end portion of the paper feed shaft 12*a* which extends through the rear of the image forming apparatus body, a clutch means 27 and a driving gear 28 are mounted so that the power from a driving source (not shown) is transmitted via the driving gear 28 and the clutch means 27 to the paper feed shaft 12*a*.

The middle portion of the paper feed shaft 12*a* of the paper feed roller assembly 12 is rotatably supported by a bearing 70. The bearing 70 is supported on a paper feed shaft supporting plate 29. As shown in FIG. 3, the paper feed shaft supporting plate 29 is mounted to the mounting portion F which is a vertical portion of the guide plate 17 that guides the paper to the paper feed rollers 18 (FIG. 1). The paper feed shaft supporting plate 29 comprises a fixing portion 29*b* disposed along the mounting portion F and a bearing supporting portion 29*a* extending orthogonally from one end of the fixing portion 29*b* in the paper guiding direction of the guide plate 17, the bearing supporting portion 29*a* supporting the bearing 70. As shown in FIG. 2, the fixing portion 29*b* (FIG. 3) is provided with three pins 31, 30, and 31 disposed in this order along the paper feed shaft 12*a* and protruding toward the side of the mounting portion F of the guide plate 17. The pins 31, 30, and 31 are inserted in respective holes 65 provided in the mounting portion F of the guide plate 17, an E ring 71 being fitted on the portion of the center pin 30 protruding toward the hole 65 to fix the entire paper feed shaft supporting plate 29 to the mounting portion F of the guide plate 17.

The paper feed roller assembly 12 is provided with a paper feed section 32 mounted on the portion of the paper feed shaft 12*a* between the free end and the portion supported on the paper feed shaft supporting plate 29. The paper feed section 32 includes a pair of rollers 33 and 34 disposed appropriately spaced apart in the axial direction. The rollers 33 and 34 are connected with each other by a cylindrically shaped connecting member 35 mounted on the paper feed shaft 12*a*. The paper feed section 32 with the rollers 33 and 34 connected by the connecting member 35 is slidably mounted on the paper feed shaft 12*a*.

The roller 34 positioned nearer to the paper feed shaft supporting plate 29 is provided, as shown in FIG. 4, with a cross-shaped groove 37 formed in the end thereof nearer to the paper feed shaft supporting plate 29, a spring pin 36 fixed to the paper feed shaft 12*a* being fitted in the groove 37. The roller 34 with the spring pin 36 fitted therein receives power from the paper feed shaft 12*a* for integral rotation therewith. The spring pin 36 is fitted in the groove 37 so as to abut against the bottom surface thereof, thus preventing the roller 34 from moving toward the paper feed shaft supporting plate 29.

As shown in FIG. 2, the paper feed section 32 with the rollers 33 and 34 connected by the connecting member 35 is made to slide on the paper feed shaft 12*a* for mounting on and removal from the paper feed shaft 12*a*. When the paper feed section 32 is mounted in position on the paper feed shaft 12*a*, a U-shaped stop ring 50 is fitted on the free end of the paper feed shaft 12*a*, as shown in FIG. 5, to prevent the entire paper feed section 32 from being pulled out of the paper feed shaft 12*a*.

Figure 7:
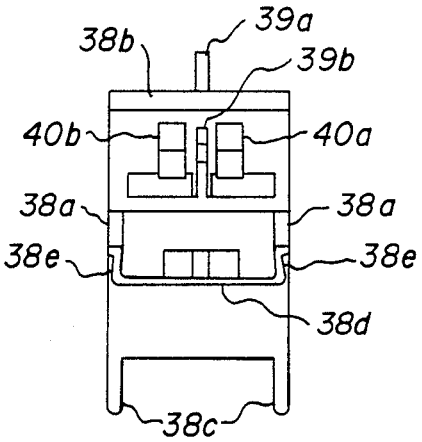
FIG. 7 is a plan view showing the paper detection switch of FIG. 6.

As shown in FIG. 2, the paper detection switch 14 has a frame body 38 positioned between the rollers 33 and 34. To the mounting portion F of the guide plate 17, the paper detection switch 14 is so fixed as to be positioned between the rollers 33 and 34 of the paper feed section 32. The frame body 38 is formed in a frame shape comprising a connecting frame 38*b* running above the portion between the rollers 33 and 34 in parallel with the paper feed shaft 12*a*, a pair of supporting frame members 38*a* extending slopingly from the respective ends of the connecting frame 38*b* toward the upstream direction of the paper feed roller assembly 12, and a swinging shaft 41 swingably disposed between the lower end portions S of the supporting frame members 38*a*. As shown in FIGS. 6 and 7, the frame body 38 includes a pair of guide portions 38*c* extending downwardly from the respective lower end portions S of the supporting frame members 38*a* and then horizontally from the ends of the respective downwardly extending portions toward the upstream direction of the paper feed roller assembly 12, each guide portion 38*c* passing below the mounting portion F of the guide plate 17. The mounting portion F of the guide plate 17 includes a vertical supporting portion F1 and a rail F2 extending horizontally from the lower end of the supporting portion F1 in the paper feeding direction of the paper feed roller assembly 12. Each lower end portion S of the supporting frame member 38*a* of the frame body 38 protrudes in an arched shape over the rail F2.

On each guide portion 38*c*, there are formed a rising portion 38*d* rising upwardly along a side surface of the supporting portion F1 of the mounting portion F, the side surface being opposite to that where the rail F2 is formed, and an engaging portion 38*e* protruding from the rising portion 38*d* toward the supporting portion F1. The rail F2 is thus surrounded by the lower end portion S of the supporting frame member 38*a*, the guide portion 38*c*, the rising portion 38*d*, and the engaging portion 38*e*. Each engaging portion 38*e* is inserted in an engaging hole h (only a portion is shown in FIG. 6) which is so provided as to engage the engaging portion 38*e* with the supporting portion F1. Each engaging hole h is formed with an appropriate size to engage the engaging portion 38*e*, and the entire paper detection switch 14 is fixed to the mounting portion F with the engaging portions 38*e* engaged in the respective engaging holes h. When the engaging portions 38*e* are not engaged in the respective engaging holes h, the lower end portions S of the respective supporting frame members 38*a* of the frame body 38 engage the rail F2 to slide thereon, thus making the entire paper detection switch 14 slide along the rail F2.

Figure 8:
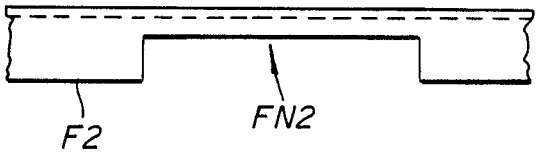
FIG. 8 is a bottom end view showing a rail of the paper feed unit of FIG. 2.
Figure 9:
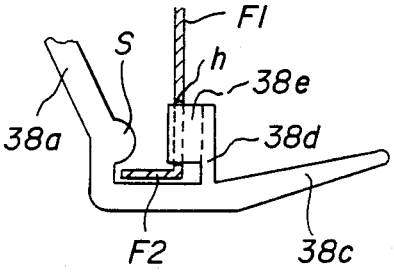
FIGS. 9 and 10 respectively are cross sectional views showing the main portion of the paper feed unit FIG. 2 for explanation of the operations of the paper detection switch.
Figure 10:
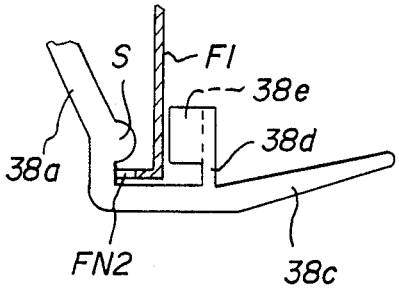

As shown in FIG. 8, the rail F2 of the mounting portion F is provided with a cut-out portion FN2 at a position appropriately away from the portion facing the paper feed section 32 toward the free end of the paper feed shaft 12*a*, the cut-out portion FN2 being formed by cutting out a portion of the edge facing the paper feed shaft 12*a*. The cut-out portion FN2 is formed of an appropriate size to accept the pair of supporting frame members 38*a* of the frame body 38. Referring to FIGS. 9 and 10, the paper detection switch 14 is made to slide on the rail F2 when the engaging portions 38*e* provided on the guide portions 38*c* of the frame body 38 as shown in FIG. 9 is disengaged from the engaging holes h as shown in FIG. 10, so that the paper detection switch 14 is moved to the position facing the cut-out portion FN2 of the rail F2. Then, with the paper detection switch 14 facing the cut-out portion FN2, the paper detection switch 14 is removed from the rail F2 by pulling the entire paper detection switch 14 downward, or if the lower end portions S of the supporting frame members 38*a* are unable to pass the cut-out portion FN2, by pulling the entire paper detection switch 14 downward while enlarging the space between the lower end portions S and the cut-out portion FN2 using the elasticity of the guide portions 38*c*, thus making the lower end portions S pass the cut-out portion FN2.

As shown in FIG. 2, on the connecting frame 38*b* in the upper part of the frame body 38, a light emitting element 40*a* and light receiving element 40*b* of a photosensor 40 are disposed appropriately spaced apart in the axial direction of the paper feed shaft 12*a*. Also, an actuating piece 39 is attached to the middle part of the swinging shaft 41 disposed between the lower end portions S of the supporting frame members 38*a* of the frame body 38. The actuating piece 39 includes an upper arm 39*b* attached to the swinging shaft 41 and extending therefrom so that its upper end is positioned between the light emitting element 40*a* and the light receiving element 40*b* of the photosensor 40 disposed on the connecting frame 38*b*, and a lower arm 39*a* attached to the swinging shaft 41 and extending therefrom downwardly of the connecting member 35 in the paper feed section 32. As shown in FIG. 6, the lower arm 39*a* has a shape curved along the circumferential surface of the connecting member 35. The arms 39*a* and 39*b* of the actuating member 39 are integrally constructed so that the arms 39*a* and 39*b* swing integrally with the swinging shaft 41. The lower arm 39*a* is pushed upward when its curved portion contacts the paper loaded in the cassette accommodated in the cassette receiver 10. When the lower arm 39*a* is pushed upward, the upper arm 39*b* is rotated away from the area where the light emitting element 40*a* and light receiving element 40*b* of the photosensor 40 face each other, thus allowing the light emitted from the light emitting element 40*a* to be received by the light receiving element 40*b*. This generates a given signal indicating the presence of the paper in the cassette, the signal being input to a given control section via a lead wire 51 (FIG. 2). On the other hand, when there is no paper in the cassette, or when the cassette is not mounted in the cassette receiver 10, the lower arm 39*a* is turned downward by its own weight, which causes the upper arm 39*b* to rotate so as to position itself in the area where the light emitting element 40*a* and light receiving element 40*b* of the photosensor 40 face each other, thus preventing the light emitted from the light emitting element 40*a* of the photosensor 40 from being received by the light receiving element 40*b* thereof. This generates a signal indicating the absence of the paper, the signal being input to the specified control section via the lead wire 51 (FIG. 2).

The guide portions 38*c* of the frame body 38 contact the paper loaded in the cassette accommodated in the cassette receiver 10, serving to prevent the paper from being buckled as well as to guide the paper for smooth feeding.

When the rollers 33 and 34 in the paper feed section 32 of the paper feed roller assembly 12 become worn, the entire paper feed section 32 is replaced. The paper feed section 32 is replaced in the following manner. First, the stop ring 50 is removed from the free end of the paper feed shaft 12*a*. Then, the paper detection switch 14 is moved in the horizontal and parallel direction to disengage the engaging portions 38*e* from the engaging holes h provided in the mounting portion F. Thus, the paper detection switch 14 becomes unfixed from the mounting portion F, the lower end portions S of the supporting frame members 38*a* now engaging the rail F2. With this state, the entire paper feed section 32 is made to slide in the direction indicated by the arrow A in FIG. 2. As a result, the entire paper detection switch 14 positioned between the rollers 33 and 34 being pushed by the roller 34, the lower end portions S of the supporting frame members 38*a* of the frame body 38 of the paper detection switch 14 are made to slide on the rail F2, thus making the entire paper detection switch 14 sliding integrally with the rollers 33 and 34. When the paper detection switch 14 is slid to reach the position facing the cut-out portion FN2 formed in the rail F2, the lower end portions S of the supporting frame members 38*a* are disengaged from the rail F2 using the cut-out portion FN2, thus removing the entire paper detection switch 14 from the rail F2. After that, the entire paper feed section 32 is made to slide on the paper feed shaft 12*a* for removal therefrom.

When the used paper feed section 32 is thus removed from the paper feed shaft 12*a*, a new paper feed section 32 is then fitted onto the paper feed shaft 12*a* from the roller 34 side. When the new paper feed section 32 is mounted on the paper feed shaft 12*a*, the paper detection switch 14 is positioned between the rollers 33 and 34, and the lower end portions S of the supporting frame members 38*a* are fitted from the cutout portion FN2 of the rail F2 to engage the rail F2. Then, the entire paper feed section 32 is made to slide on the paper feed shaft 12*a* in the direction opposite to that indicated by the arrow A in FIG. 2, thus making the paper detection switch 14 slide integrally with the paper feed section 32 along the rail F2. Thereafter, the spring pin 36 fixed to the paper feed shaft 12*a* is fitted into the groove 37 formed in the end of the roller 34, while the stop ring 50 is fitted on the free end of the paper feed shaft 12*a*. Thus, the entire paper feed section 32 is mounted in position, being prevented from being pulled out of the paper feed shaft 12*a*. Then, the engaging portions 38*e* of the paper detection switch 14 are inserted in the engaging holes h provided in the mounting portion F, thereby fixing the entire paper detection switch to the mounting portion F. The paper detection switch 14 is thus installed in position.

In this embodiment, the paper feed roller assembly 11 and the paper detection switch 13 in the upper cassette paper feed means 4 have the same construction as the paper feed roller assembly 12 and the paper detection switch 14 in the above described lower cassette paper feed means 5. Therefore, the description of them is omitted.

Figure 11:
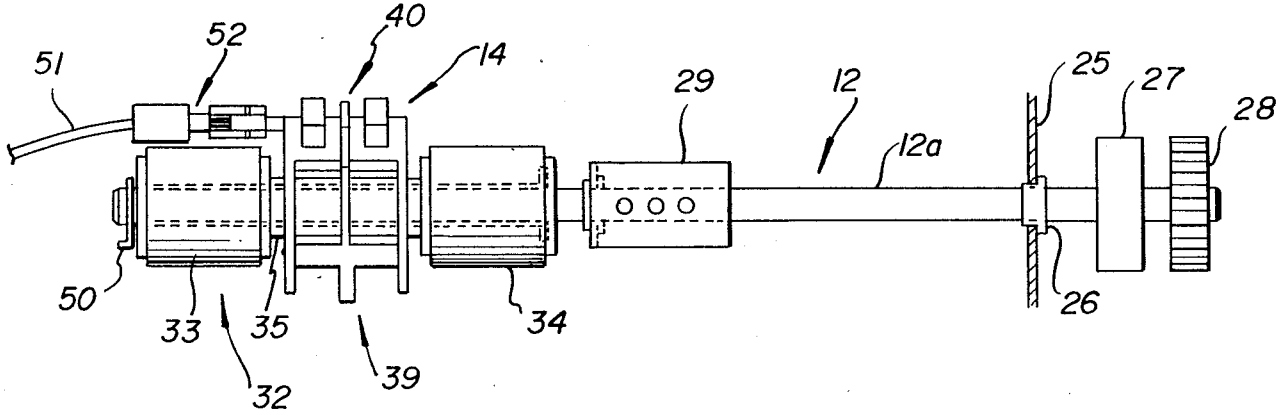
FIG. 11 is a plan view showing another paper feed unit of the present invention.
Figure 1:
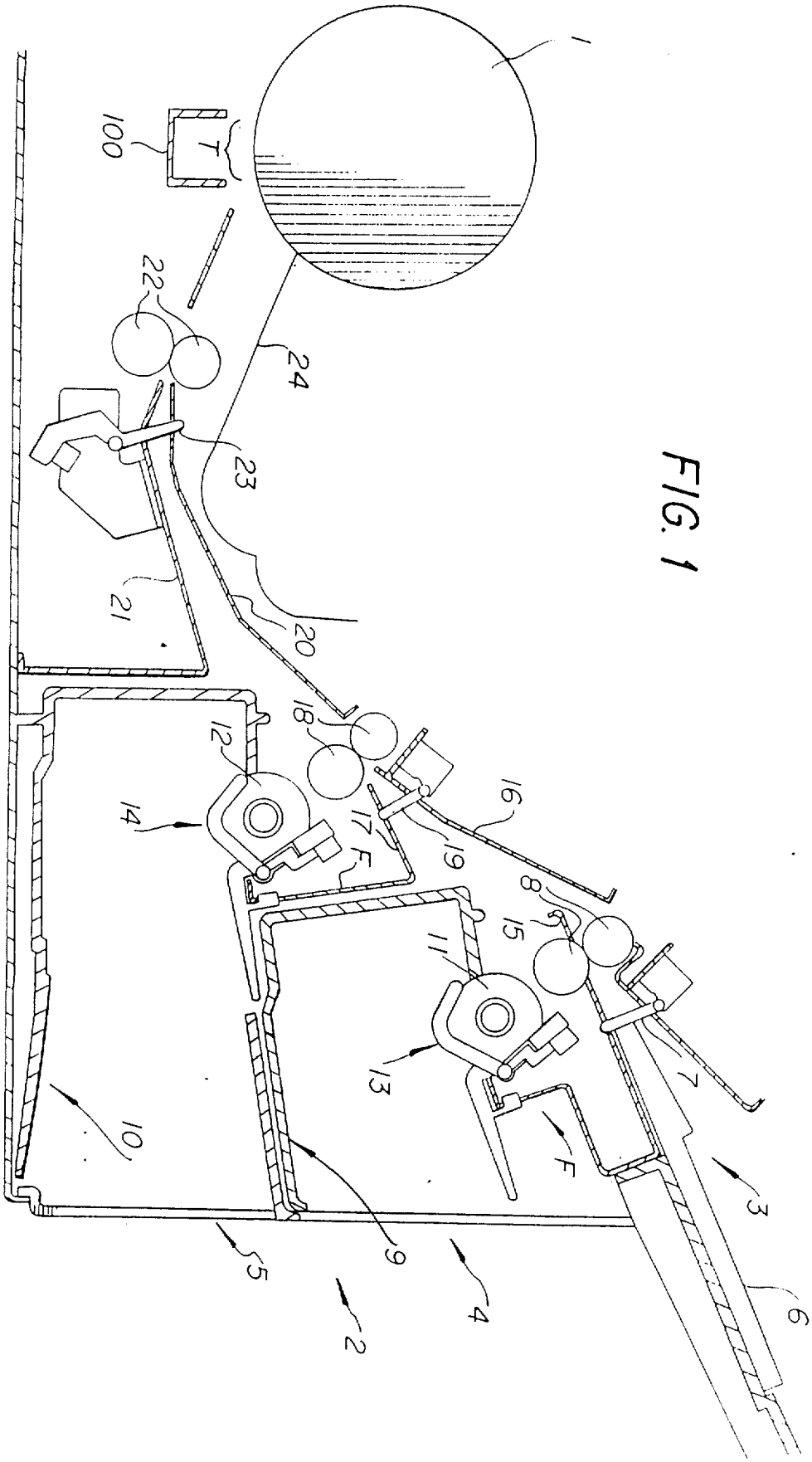

In the above embodiment, when the paper detection switch 14 is made to slide for removal of the paper feed section 32, the lead wire 51 attached to the paper detection switch 14 has to be moved to follow the sliding paper detection switch 14, but if the paper detection switch 14 is made to connect with the lead wire 51 by means of a connector 52, as shown in FIG. 11, in the vicinity of the paper detection switch 14 fixed to the mounting portion F, it is not necessary to move the lead wire 51 when sliding the paper detection switch 14 for removal of the paper feed section 32. When removing the paper feed section 32 from the paper feed shaft 12*a*, the lead wire 51 is disconnected from the paper detection switch 14 by unfastening the connector 52, and after mounting the new paper feed section 32 on the paper feed shaft 12*a*, the paper detection switch 14 is connected to the lead wire 51 by fastening the connector 52.

Also, in the above embodiment, the cut-out portion FN2 is provided in the rail F2 of the mounting portion F on which the paper detection switch 14 is mounted, the cut-out portion FN2 being used to disengage the paper detection switch 14 from the rail F2, but instead of providing the cut-out portion FN2 in the rail F2, the rail F2 may be cut off at the position where the cut-out portion FN2 is to be provided, the paper detection switch 14 being disengaged from the rail F2 by sliding it on the rail F2 and taking it out from the cut off end.

Also, the paper feed shaft 12*a* has one end supported on the side panel 25 and the other end made free, but alternatively, both ends may be rotatably supported.

Figure 12:
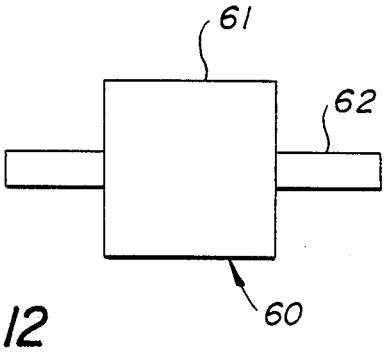
FIG. 12 is a front view showing another paper feed section of the paper feed unit of the present invention.

Further, in the above embodiment, the paper feed section 32 in the paper feed roller assembly 12 has two rollers 33 and 34, but it may be so constructed as to have more than two rollers or only one roller. Also, a paper feed section 60 as shown in FIG. 12 may be provided which comprises a roller section 61, and a supporting shaft 62 inserted through the axis of the roller section 61 and mounted integrally with the roller section 61, the supporting shaft 62 being mounted on the paper feed shaft 12*a*. The paper feed section 60 of such construction is mounted on the paper feed shaft 12*a* by a method such as disclosed in Japanese Laid-Open Utility Model Publication No. 63-41040, or proposed in Japanese Patent Application No. 63-155711.

In the above embodiment, the paper feed unit is so constructed that the paper detection switch 14 detects the paper contained in the cassette which is mounted in the cassette receiver 10 by sliding thereinto. However, the construction is not limited to that of the above embodiment. For example, in the case of a paper feed unit having an elevator-type driving unit for lifting a paper contained in the paper container, the paper detection switch may be so provided as to detect the uppermost sheet therein.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A paper feed unit for image forming apparatuses comprising a paper feed roller assembly having a paper feed shaft rotatably supported in the body of the image forming apparatus and a paper feed section slidably mounted on the paper feed shaft for removal therefrom and fixed to the paper feed shaft for integral rotation therewith, the rotation of said paper feed section causing a roller of said paper feed roller assembly to rotationally contact paper, thereby feeding the paper; and a paper detection switch so fixed to a given mounting portion adjacent to the paper feed section as to detect the presence of the paper to be fed by the paper feed roller assembly and mounted in such a way as to slide following a slide in the paper feed section when unfixed from the mounting portion.

2. A paper feed unit for image forming apparatuses according to claim 2, wherein said paper feed section of the paper feed roller assembly comprises a plurality of rollers mounted appropriately spaced apart on the paper feed shaft, and a connecting member mounted on the paper feed shaft for connecting the rollers.

3. A paper feed unit for image forming apparatuses according to claim 2, wherein said paper detection switch is so fixed to the mounting portion as to position itself between the adjacent rollers.

4. A paper feed unit for image forming apparatuses according to claim 3, wherein said mounting portion is provided with a rail which the paper detection switch unfixed from the mounting portion engages with and slide on, the rail being formed in parallel with the paper feed shaft.

5. A paper feed unit for image forming apparatuses according to claim 4, wherein said rail is provided with a cut-out portion to facilitate the unfixing of the paper detection switch.

6. A paper feed unit for image forming apparatuses according to claim 3, wherein said paper detection switch is connected to a lead wire by means of a connector when fixed to the mounting portion.

7. A paper feed unit for image forming apparatuses according to claim 1, wherein one end of the paper feed shaft is supported on the body of the image forming apparatus.

8. A paper feed unit for image forming apparatuses according to claim 1, wherein said paper feed section has a roller section and a supporting shaft inserted through the axis of the roller section and mounted integrally with the roller section.

* * * * *

UNITED STATES PATENT AND TRADEMARK OFFICE

CERTIFICATE OF CORRECTION

PATENT NO. : 4,966,359

DATED : October 30, 1990

INVENTOR(S) : Kiyotaku ARAI

It is certified that error appears in the above-identified patent and that said Letters Patent is hereby corrected as shown below:

On the drawing sheet 1 of 5, Fig. 1 please insert an arrow on reference numeral 9 and a lead line reference numeral 17, as shown on the attached page.

Signed and Sealed this

Thirtieth Day of June, 1992

*Attest:*

DOUGLAS B. COMER

*Attesting Officer*

*Acting Commissioner of Patents and Trademarks*